US006805459B1

(12) United States Patent
Prescott et al.

(10) Patent No.: US 6,805,459 B1
(45) Date of Patent: Oct. 19, 2004

(54) SELF-ILLUMINATING BOOK

(75) Inventors: Steven Prescott, Edmonton (CA); Dawn Prescott, Edmonton (CA)

(73) Assignee: Transglobal Communications Group, Inc., Edmonton (CA)

( * ) Notice: Subject to any disclaimer, the term of this patent is extended or adjusted under 35 U.S.C. 154(b) by 0 days.

(21) Appl. No.: 10/094,044

(22) Filed: Mar. 7, 2002

(51) Int. Cl.[7] ..... F21V 33/00
(52) U.S. Cl. ..... 362/99; 362/98
(58) Field of Search ..... 362/98, 99, 97, 362/127, 109; 40/124.02

(56) References Cited

U.S. PATENT DOCUMENTS 4,209,824 A 6/1980 Kaufman
4,363,081 A 12/1982 Wilbur
5,118,138 A 6/1992 Brotz
5,460,414 A 10/1995 Sargis
5,597,183 A 1/1997 Johnson
5,988,684 A 11/1999 Blaustein et al.

*Primary Examiner*—Thomas M. Sember
*Assistant Examiner*—Hargobind S. Sawhney
(74) *Attorney, Agent, or Firm*—Troutman Sanders LLP; Ryan A. Schneider

(57) ABSTRACT

A self-illuminating book having an integral light source and at least one page having a portion thereof "notched out", or "cut out", to receive at least a portion of the light source therethrough, thereby enabling light from the light source to illuminate the page and other portions of the book and to improve lighting conditions for reading or viewing of the book. Preferably, the light source is attached to the inner surface of the book's back cover and is transitioned between on and off positions by depressing and subsequently releasing a lens cover thereof, thereby allowing a person having minimal dexterity to easily turn the light source on or off as necessary.

18 Claims, 3 Drawing Sheets

SELF-ILLUMINATING BOOK

FIELD OF THE INVENTION

The present invention relates, generally, to the field of books and, in a preferred embodiment, to a self-illuminating book having pages shaped cooperatively with an integral light source.

BACKGROUND OF THE INVENTION

For many years, physicians and other medical authorities have known and taught patients that the reading of books, magazines, and other printed material in the absence of proper lighting may cause eyestrain, headaches, and, over time, potentially contribute to the degradation of a reader's vision. The same physicians and medical authorities have also taught patients that, in order to avoid such harmful effects when reading, the printed material should be illuminated by a light source of appropriate intensity which is located behind a shoulder of the reader. However, because readers may desire or need to read printed material in a location where such optimum illumination is not available, readers often find themselves reading printed material under less than optimum conditions.

A number of inventors have attempted to develop lighting devices which may be employed by readers in order to simulate optimum illumination conditions and to, thereby, avoid or lessen the harmful effects of reading printed material in less than optimum lighting conditions. For example, some inventors have developed lighting devices which may be removably attached to a cover of a book. Generally, such lighting devices have a clamp-like structure which enables attachment to a cover of the book and have a flexible or movable structure including a light source which extends from the clamp-like structure. By adjusting or otherwise manipulating the flexible or movable structure after attachment of the lighting device to the book, a reader may position the light source at a location which simulates optimum illumination conditions.

Unfortunately, such lighting devices are often cumbersome to handle and may be difficult for a reader to attach to the cover of the book. As a consequence, such lighting devices may be adequate for adults, but are less than ideal for children who do not have the dexterity or understanding necessary to handle such devices and whose vision it is even more important to protect than adults. Also, the cumbersome and purely functional nature of such lighting devices does not entice or encourage children to read and may, perhaps, even discourage children from reading due to the difficulties encountered when trying to use the devices. Additionally, the light sources of such devices may be difficult for children to turn on and off, and may become hot during use, thereby creating a safety hazard for small children.

Another inventor has attempted to address the afore-described deficiencies by providing a book with a light source embedded in the book's spine. The book's pages are each formed in a sandwich-like structure from an opaque sheet positioned adjacent to and between two transparent sheets. An edge of each transparent sheet resides adjacent to the light source so that light from the light source passes into the transparent sheets through their edges, thereby illuminating printing and/or illustrations on the transparent and/or opaque sheets. The opaque sheet of each page prevents printing and/or illustrations on the opposite side of a page or on other pages from being visible to a reader at the same time.

While a book having an embedded light source and pages formed from transparent (and, potentially, washable) material might seem desirable for children, light from the book's embedded light source provides, essentially, backlighting of the printing and/or illustrations on the book's pages and does not strike the book's pages and reflect to a reader's eyes in a manner similar to light created by a light source optimally positioned behind a shoulder of the reader. Also, due to variations and/or imperfections in the transparent sheets of such a book, light may not be distributed equally to various regions of the pages, thereby creating light intensity differences in those regions and rendering difficult the reading or viewing of printing and/or illustrations in those regions. In addition, because the light source is embedded in the spine of the book, an on-off switch for the light source may necessarily be positioned in a location which is hidden from view and/or difficult for adults or children to reach.

Therefore, there exists in the industry, a need for a self-illuminating book having an integral light source which requires no attachment, which acceptably and more optimally illuminates the book's pages, and which address these and other related, and unrelated, problems.

SUMMARY OF THE INVENTION

Briefly described, the present invention comprises a self-illuminating book having its own light source, thereby enabling the self-illuminating book to be read or viewed by a reader in any environment, including those environments having less than optimal lighting conditions. More particularly, the present invention includes a self-illuminating book having a light source and a page having a notch, or cut out, to receive at least a portion of the light source therethrough, thereby enabling light from the light source to illuminate the page and other portions of the book.

According to a preferred embodiment of the present invention, a self-illuminating book presents a children's story and includes a light source in the shape of crescent moon fixedly secured to the book's back cover. The book further includes a front cover and a plurality of pages which each have a notch, or cut out, so that the front cover and pages each have an arcuately shaped edge which cooperates with an arcuate shaped portion of the light source housing and enables at least a portion of the light source to protrude, or extend, therethrough. As an advantageous consequence thereof, when the book is in an open orientation and a page of the book is in a position substantially parallel to the back cover, a portion of the light source protrudes through the notch, or cut out, of the page, thereby allowing light from the light source to directly illuminate the page, or pages, to which the book is opened or, perhaps, those pages located more toward the book's front cover (i.e., and without traveling through the page material and backlighting the printing thereon). Absent the page being "notched out", or "cut out", light from the light source would be blocked by the page overlaying the light source and, hence, could not illuminate pages nearer the book's front cover. Similarly, the notch, or cut out, of the book's front cover enables at least a portion of the light source to protrude through the front cover, thereby beneficially allowing light from the light source to illuminate the outer surface of the front cover when the book is in a "closed" orientation. As an additional advantage, the notch, or cut out, of the book's front cover permits the light source to become part of the design of the book's front cover. In the children's book of the preferred embodiment, a portion of the crescent moon shaped light source protrudes through the book's front cover and serves to attract a child's attention and thereby, encourage a child to read or view the book.

Notably, the light source of the present invention's preferred embodiment is fixedly secured to the book's back cover and cannot be easily removed by a child. By virtue of the light source being permanently affixed to the book's back cover, there is no need for a child to deal with trying to attach a cumbersome light source to his/her book, thereby eliminating at least one of the difficulties present in prior art lighting devices. Also, because the light source is turned-on and turned-off by depressing and releasing the relatively large lens cover of the light source, a child may easily turn the light source on and off without being confronted with and confused by switches requiring more dexterity and understanding to operate than many children have. Further, since the light source receives electrical energy for operation from a battery and is substantially cool to the touch, the light source of the present invention reduces the possibility of a child being burned by the light source.

Accordingly, it is an object of the present invention to illuminate the pages of a book for reading by a reader.

Another object of the present invention is to illuminate the pages of a book with light from a light source permanently secured to the book.

Still another object of the present invention is to illuminate the pages of a book with a light source that is safe for readers and, particularly, safe for children.

Still another object of the present invention is to illuminate the pages of a book with a light source that is easily turned-on and turned-off, particularly, by a child.

Still another object of the present invention is to encourage children to read.

Still another object of the present invention is to provide a book.

Other objects, features, and advantages of the present invention will become apparent upon reading and understanding the present specification when taken in conjunction with the appended drawings.

DETAILED DESCRIPTION OF THE INVENTION'S EMBODIMENTS

Figure 1:
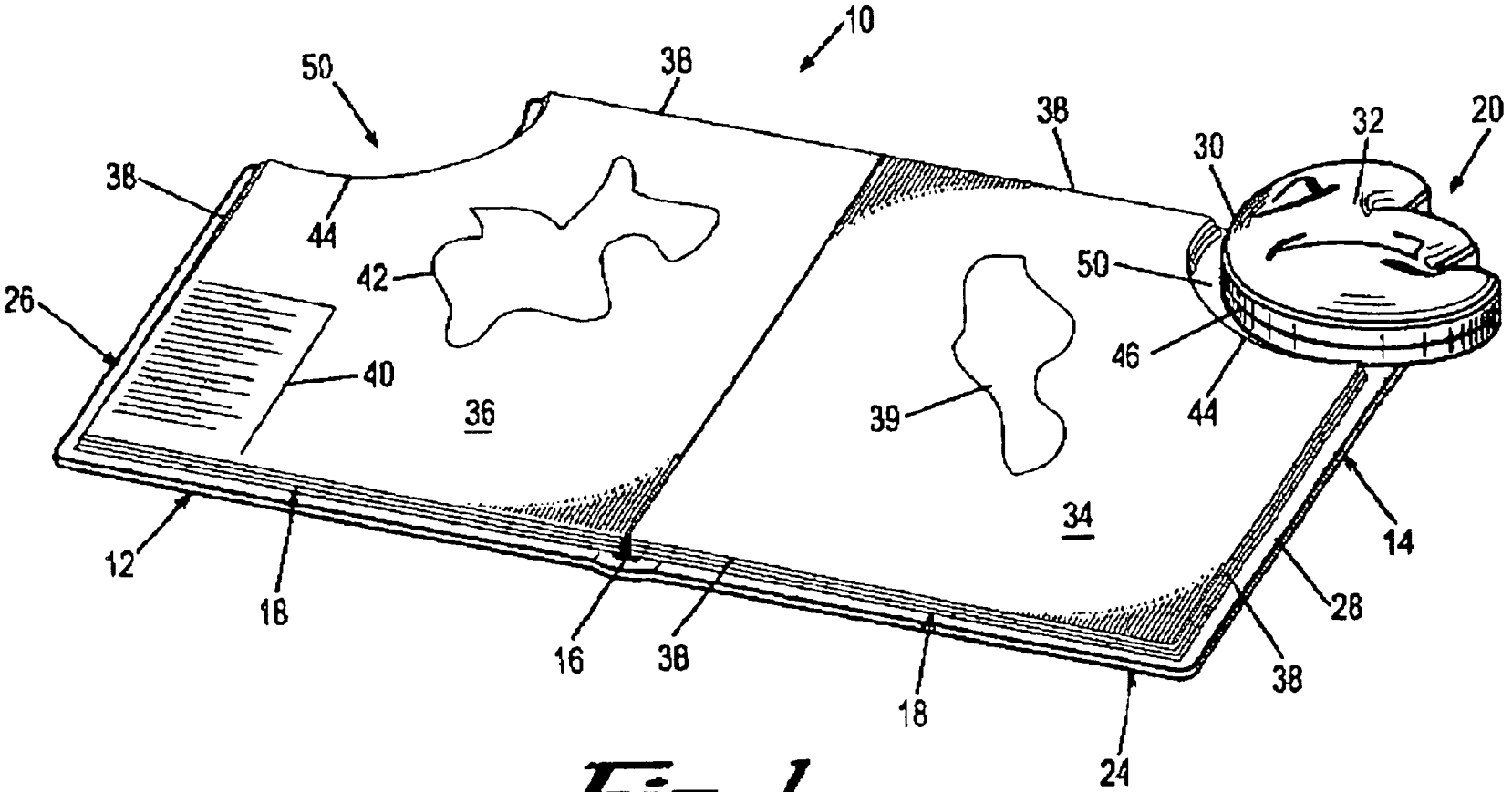
FIG. 1 is a front, perspective view of a self-illuminating book, in accordance with the preferred embodiment of the present invention, which is opened to a particular page.

Referring now to the drawings in which like numerals represent like elements throughout the several views, FIG. 1 displays a perspective view of a self-illuminating children's book 10 (also sometimes referred to herein as the "book 10") according to a preferred embodiment of the present invention. The self-illuminating book 10 presents a children's story to a reader and comprises a front cover 12, a back cover 14, a spine 16, a plurality of pages 18 movably bound to the spine 16 and between the front and back covers 12, 14, and a light source 20. The front and back covers 12, 14 are, preferably, manufactured from a rigid material and have respective outer surfaces 22, 24 and respective inner surfaces 26, 28. Generally, the inner surfaces 26, 28 and outer surfaces 22, 24 of the front and back covers 12, 14 include text and/or illustrations thereon which identify the title of the story presented to a reader by the book 10, illustrate characters or scenes of the story, and/or provide portions of the story's text.

The light source 20, in accordance with the preferred embodiment, is directly mounted and fixedly attached to the inner surface 28 of the back cover 14 of the book 10. The light source 20 comprises a base 30 and a lens cover 32 which, together, enclose a light bulb, battery, and switch (not shown). The light bulb and battery are electrically connected such that the light bulb does not produce light when the switch is in an "open" state, and produces light when the switch is in a "closed" state. The lens cover 32 is, preferably, movable relative to the base 30 in response to a reader depressing and releasing the lens cover 32 (i.e., as indicated by the double-headed arrow in FIG. 3). Such movement of the lens cover 32 actuates the switch, thereby causing the switch to toggle between the open and closed states and the light source 20 to toggle, respectively, between not producing light or producing light. The lens cover 32, during operation of the light source 20, may direct and/or filter light produced by the light bulb.

It should be understood that the scope of the present invention includes, but is not limited to, light sources 20 having incandescent bulbs, florescent bulbs, black light bulbs, or other devices which are capable of producing light. Also, it should be understood that the scope of the present invention includes, for example and not limitation, light sources 20 using electrical energy provided by one or more batteries, an electric cord, or other structure or method of storing and/or transmitting electrical energy. Additionally, it should be understood that the scope of the present invention includes, without limitation, light sources 20 having different types of switches or other structures for turning-on and turning-off the generation of light therefrom.

Figure 2:
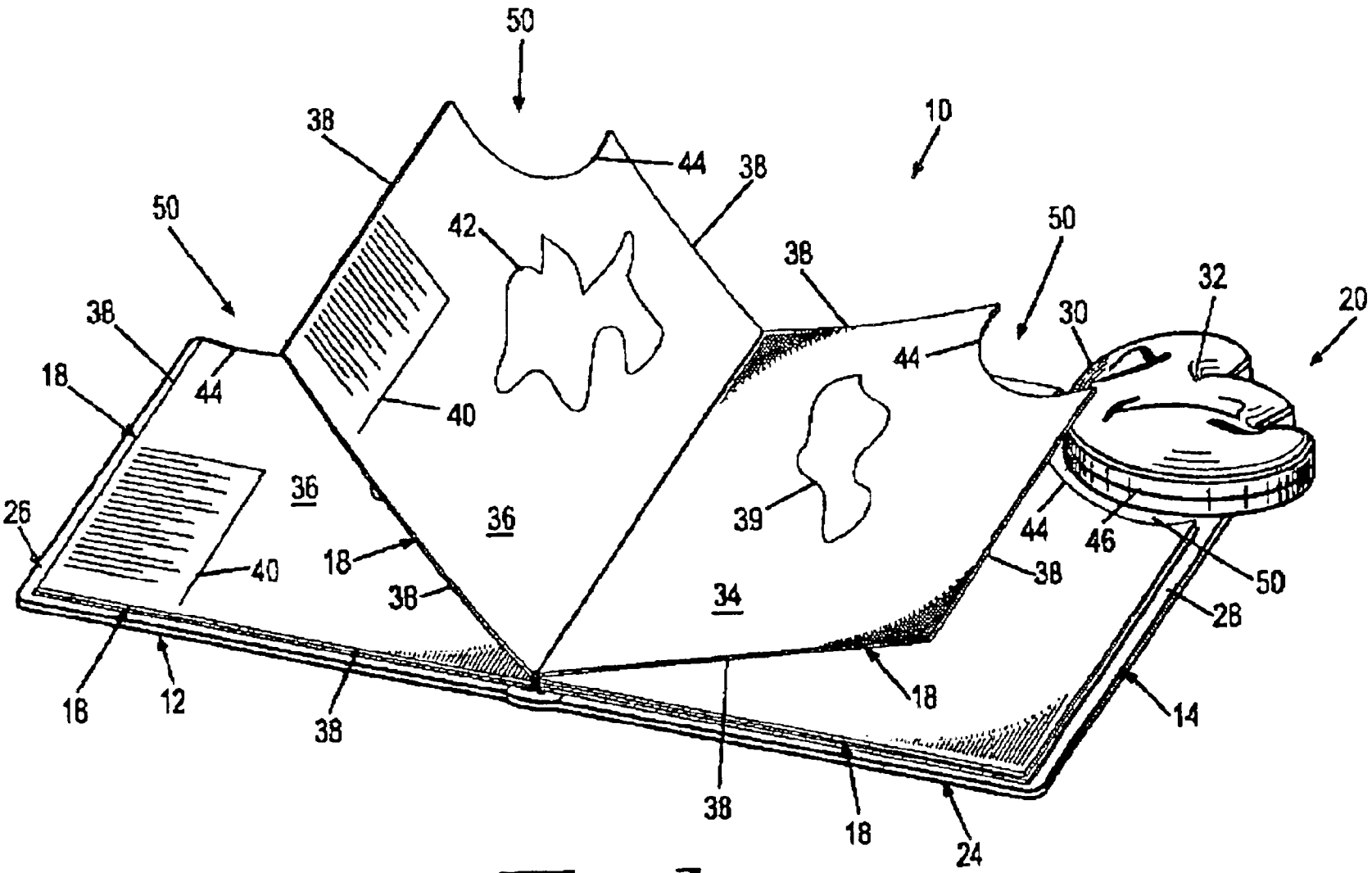
FIG. 2 is a front, perspective view of the self-illuminating book of FIG. 1 in which a plurality of pages are in the process of being turned by a reader.
Figure 4:
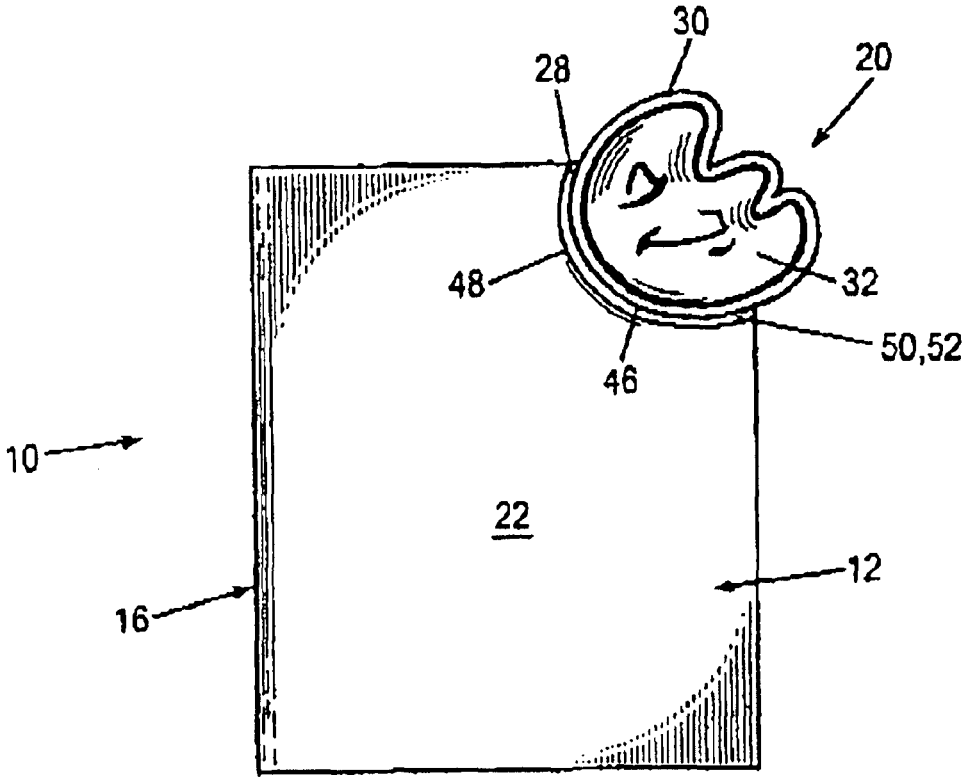
FIG. 4 is a top, plan view of the self-illuminating book of FIG. 1, displaying the light source protruding the pages and front cover thereof.

According to the preferred embodiment and as seen in FIGS. 1, 2 and 4, the light source 20 has a shape in the form of a crescent moon and is positioned near the upper, rightmost portion of the back cover 14 of the book 10. The crescent moon shape of the light source 20 is, generally, attractive to children and encourages children to read or view the book 10. In alternate embodiments, the light source 20 may be mounted to the front cover 12, at other locations on the back cover 14, or on a page 18 or other surface located between the front and back covers 12, 14. Further, the light source 20 may be formed in the shape of a full moon, star, light bulb, or other object which is normally considered, like a crescent moon, to provide light and which may attract a child or other reader's attention to the book 10.

The pages 18 of the book 10 are, preferably, manufactured from a single ply of rigid material on which text and graphical illustrations are printed. The ply of each page 18 is sufficiently rigid and thick so as to enable children having minimal dexterity to more easily handle and turn the pages 18. Alternatively, the pages 18 may be manufactured from multiple plies of various materials and/or have an applied coating which resists marring or other degradation of the text or graphical illustrations printed thereon. In the preferred embodiment, each page 18 of the book 10 has a front surface 34, a back surface 36, and an edge 38 which extends around the periphery of the page 18 between the front and back surfaces 34, 36. The front surface 34 of each page 18, generally, includes a portion 39 having a graphical illustration which depicts one or more characters of the book's story, a scene from the story, or images that enhance the reader's understanding and/or comprehension of the story. The back surface 36 of each page 18, typically, includes a first portion 40 having the story's text printed therein and a second portion 42 having a graphical illustration similar to that of portion 38 of the page's front surface 34. The relative sizes of portions 39, 40, 42 may vary, as appropriate, from page 18 to page 18 such that portions 39, 40, 42 may extend to a page's edge 38 or be contained within a smaller area of a page 18. In alternate embodiments, each surface 34, 36 of each page 18 may include one or more portions having text, having graphical illustrations, and/or having a combination thereof.

Figure 3:
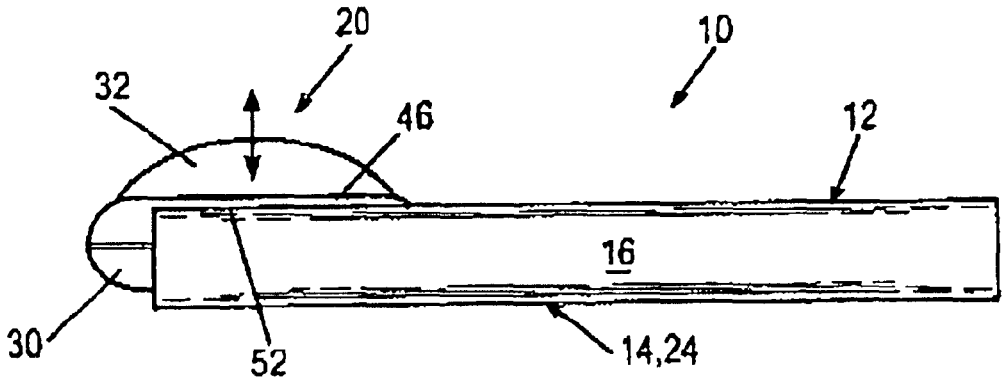
FIG. 3 is a side, elevational view of the self-illuminating book of FIG. 1, displaying the light source protruding the pages and front cover thereof.

In accordance with the preferred embodiment, the edge 38 of each page 18 has a substantially linear portion (not visible in the figures) which resides adjacent the book's spine 16 and is secured thereto in a manner which enables a reader to hingedly move the page 18 relative to the spine 16, thereby enabling the reader to "turn" the page 18 and view other pages 18 of the book 10 (see FIG. 2). Notably, the edge 38 of each page 18 also has a substantially arcuate portion 44 (i.e., defining a notch 50, or cut out 50, of each page 18) having a curvature substantially similar to, or mirroring, an arcuate portion 46 of the light source 20. The arcuate portion 44 of the edge 38 of each page 18 is shaped so as to reside substantially adjacent to the arcuate portion 46 of the light source 20 when the page 18 has its back surface 36 in an orientation substantially parallel to the back cover 14 of the book 10. The arcuate portion 44 of the edge 38 (i.e., and the notch 50 of each page 18) cooperates with the arcuate portion 46 of the light source 20, thereby enabling each page 18 of the book 10 to cooperatively receive the light source 20 when in such an orientation (i.e., enabling at least a portion of the light source 20 to extend or protrude, as seen in FIGS. 3 and 4, through the notch 50 and at least a portion of each page 18 of the book 10). Further, as seen in FIG. 4, the front cover 12 of the book 10, preferably, has a similarly shaped arcuate portion 48, which defines a notch 52 in the front cover 12 that cooperatively receives the light source 20 (i.e., and allows at least a portion of the light source 20 to extend or protrude through the notch 52 and at least a portion of the front cover 12 as seen in FIG. 3) when the front cover 12 is positioned in a "closed" orientation with its inner and outer surfaces 26, 22 substantially parallel to the book's back cover 14.

Note that by virtue of the "notching out" of each of the book's otherwise substantially rectangular shaped pages 18 to define a notch 50 and a page edge 38 having an arcuate portion 44 cooperative with the periphery of the light source 20, light generated by the light source 20 is allowed to illuminate the pages 18 to which the book 10 is opened (i.e., if each page 18 was not notched out, then the light source 20 would be covered, or blocked, by a page 18 of the book 10 and previous pages 18 nearer the book's front cover 12 would not receive light from the light source 20). Note also that by "notching out" the book's otherwise substantially rectangular shaped front cover 12 to define a notch 52 and an edge having an arcuate portion 48, light emitted by the light source 20 is allowed to be incident upon the outer surface 22 of the front cover 12, thereby enabling a reader to view text or graphical illustrations present on the outer surface 22 of the book's front cover 12 when sufficient light is otherwise unavailable. As an additional benefit of "notching out" the book's pages 18 and front cover 12, the light source's entertaining and appealing crescent moon shape is visible when the front cover 12 of the book 10 is positioned in a "closed" orientation, thereby attracting a child's attention to the book 10 and enabling the light source 20 to be integrated into the design of the front cover 12 and the entire "look and feel" of the book 10.

It should be understood that the scope of the present invention includes, as previously noted, a book 10 having light sources 20 with different shapes and, therefore, a front cover 12 and/or pages 18 having portions cooperative with such light sources 20 that have correspondingly different shapes. For example and not limitation, if the light source 20 in an alternate embodiment has the shape of a star, then the front cover 12 and/or pages 18 of the book 10 may have notches, or cut outs, and edges that cooperate with the light source 20 to receive the entire light source 20 or a portion thereof (i.e., and allow at least a portion of the light source 20 to extend or protrude therethrough) when the book 10 is in a "closed" orientation.

Further, it should be understood that the scope of the present invention includes an alternate embodiment in which a series of self-illuminating books for older children have a light source which is sharable and usable by more than one such book. For example and without limitation, a plurality of self-illuminating books may each include a cover and pages which have a notch, or cut out, having substantially the same shape and size, thereby enabling a light source having a cooperative shape to be removed from one such book and attached to a second book of the plurality of books (i.e., at the similar corresponding notch, or cut out, of the second book) to enable illumination of the second book. In such an exemplary embodiment, the books and light source may use an attachment apparatus and method which allows the light source to be easily removed from one book and attached to another by a child, and may include the use of hook and loop fasteners.

To read or view the book 10 of the present invention in an environment in which optimum lighting is not available, a child orients the book 10 so that the outer surface 22 of the book's front cover 12 is facing the child with any text thereon "right-side up". The child then depresses the lens cover 32 of the light source 20 until the switch is actuated, thereby causing the light source 20 to emit light. Next, the child may progressively read the text and view the illustrations present on the various pages 18 of the book 10, under illumination by the light source 20, until the child has reviewed all of the pages 18. Upon completion of the child's reading or viewing the last page 18, the child once again depresses the lens cover 32 of the light source 20 to actuate the switch, thereby causing the light source 20 to cease the emission of light.

Whereas this invention has been described in detail with particular reference to its preferred embodiment and variations thereof, it is understood that other variations and modifications may be effected within the spirit and scope of the invention, as described herein before and as defined in the appended claims. The corresponding structures, materials, acts, and equivalents of all means plus function elements, if any, in the claims below are intended to include any structure, material, or acts for performing the functions in combination with other claimed elements as specifically claimed.

What is claimed is:

1. A self-illuminating book, comprising:

a first cover having an inner surface and a perimeter, said first cover further having an edge extending about said perimeter of said first cover;

a second cover, wherein said first and second covers are positionable in a closed orientation in which said second cover is opposed to said first cover;

a light source connected to said inner surface of said first cover at a position proximate said edge of said first cover, wherein said light source includes an enclosure having a nonlinear-shaped portion and a light bulb and a battery, said light bulb and said battery residing within said enclosure; and, a plurality of pages connected between said first cover and said second cover, wherein each page of said plurality of pages has a perimeter and an edge extending about said perimeter of each said page, wherein said edge of each said page has a nonlinear-shaped portion which resides adjacent to and extends substantially parallel to said nonlinear-shaped portion of said enclosure of said light source when said first and second covers are positioned in said closed orientation, and, wherein a substantial portion of a page of said plurality of pages resides in contact with and against said inner surface of said first cover when said first and second covers are positioned in said closed orientation.

2. The self-illuminating book of claim 1, wherein said nonlinear-shaped portion of said edge of each said page extends at least partially around said nonlinear-shaped portion of said enclosure of said light source when said first and second covers are positioned in said closed orientation.

3. The self-illuminating book of claim 1, wherein at least one page of said plurality of pages defines a plane when said first and second covers are positioned in said closed orientation, and wherein at least a portion of said enclosure of said light source protrudes from said first cover and extends at least partially through said plane when said first and second covers are positioned in said closed orientation.

4. The self-illuminating book of claim 1, wherein said nonlinear-shaped portion of said enclosure of said light source is substantially arcuate and said nonlinear-shaped portion of said edge of each said page of said plurality of pages is substantially arcuate.

5. The self-illuminating book of claim 1, wherein said enclosure of said light source is shaped similar to a moon.

6. The self-illuminating book of claim 1, wherein said enclosure of said light source is shaped similar to a star.

7. The self-illuminating book of claim 1, wherein said enclosure of said light source has a depressible portion, said light source being operable by depression of said depressible portion thereof.

8. The self-illuminating book of claim 1, wherein said first cover is a back cover.

9. The self-illuminating book of claim 1, wherein said self-illuminating book presents a children's story, and wherein a page of said plurality of pages includes at least one illustration associated with said children's story.

10. The self-illuminating book of claim 1, wherein said enclosure of said light source is removable from said first cover.

11. A self-illuminating book, comprising:

a first cover having an inner surface and a perimeter, said first cover further having an edge extending about said perimeter of said first cover;

a light source connected to said inner surface of said first cover at a position proximate said edge of said first cover, wherein said light source includes an enclosure having a nonlinear-shaped portion and a light bulb and a battery, said light bulb and said battery residing within said enclosure;

a second cover positionable in a closed orientation with said first cover in which said second cover is opposed to said first cover, wherein said second cover has a perimeter and an edge extending about said perimeter of said second cover, and wherein said edge of said second cover has a nonlinear-shaped portion which resides adjacent to and extends substantially parallel to said nonlinear-shaped portion of said enclosure of said light source when said first and second covers are positioned in said closed orientation; and, a page intermediate said first cover and said second cover, wherein a substantial portion of said page resides in contact with and against said first cover when said first and second covers are positioned in said closed orientation.

12. The self-illuminating book of claim 11, wherein said nonlinear-shaped portion of said edge of said second cover extends at least partially around said nonlinear-shaped portion of said enclosure of said light source when said first and second covers are positioned in said closed orientation.

13. The self-illuminating book of claim 11, wherein said second cover defines a plane, and wherein at least a portion of said enclosure of said light source protrudes from said first cover and extends at least partially through said plane when said first and second covers are positioned in said closed orientation.

14. The self-illuminating book of claim 11, wherein said enclosure of said light source is shaped similar to a moon.

15. The self-illuminating book of claim 11, wherein said enclosure of said light source is shaped similar to a star.

16. The self-illuminating book of claim 11, wherein said light source further comprises an actuator for causing operation of said light source.

17. The self-illuminating book of claim 11, wherein said second cover is a front cover.

18. The self-illuminating book of claim 11, wherein said page has a perimeter and an edge extending about said perimeter of said page, said edge having a nonlinear-shaped portion, and wherein said nonlinear-shaped portion of said edge of said second cover and said nonlinear-shaped portion of said edge of said page have substantially similar shapes.

* * * * *